US006676444B2

(12) United States Patent
Noro

(10) Patent No.: US 6,676,444 B2
(45) Date of Patent: Jan. 13, 2004

(54) CONNECTOR FOR A FLAT CABLE AND METHOD OF ASSEMBLING IT

(75) Inventor: Yutaka Noro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/307,825

(22) Filed: Dec. 2, 2002

(65) Prior Publication Data

US 2003/0114046 A1 Jun. 19, 2003

(30) Foreign Application Priority Data

Dec. 14, 2001 (JP) ..... 2001-381247

(51) Int. Cl.[7] ..... H01R 9/05

(52) U.S. Cl. ..... 439/579; 439/607; 439/497; 439/610

(58) Field of Search ..... 439/579, 607, 439/495, 497, 610

(56) References Cited

U.S. PATENT DOCUMENTS

| | | | | | |
|---|---|---|---|---|---|
| 4,619,487 | A | * | 10/1986 | Brush, Jr. | 439/98 |
| 4,772,212 | A | * | 9/1988 | Sotolongo | 439/98 |
| 5,605,469 | A | * | 2/1997 | Wellinsky et al. | 439/417 |
| 5,980,308 | A | * | 11/1999 | Hu et al. | 439/497 |
| 6,007,385 | A | * | 12/1999 | Wu | 439/610 |
| 6,162,086 | A | * | 12/2000 | Kuo | 439/497 |
| 6,364,702 | B1 | | 4/2002 | Mochizuki et al. | |

* cited by examiner

*Primary Examiner*—Tho D. Ta
(74) *Attorney, Agent, or Firm*—Anthony J. Casella; Gerald E. Hespos

(57) ABSTRACT

A connector includes a housing (20) for holding an end of a flat cable (10). The connector also has a shielding shell (40) with a base shell (41) and a lid shell (42) for enclosing the housing (20). Locks (72, 73) are provided at the rear ends of the base shell and lid shells (41, 42) for locked engagement with each other to keep the base and lid shells (41, 42) closed around the housing (20).

14 Claims, 10 Drawing Sheets

CONNECTOR FOR A FLAT CABLE AND METHOD OF ASSEMBLING IT

BACKGROUND OF THE INVENTION

1. Field of the Invention

The invention relates to a connector for a plurality of shielded wires that have at least their ends arranged substantially side by side.

2. Description of the Related Art

A known flat cable has a plurality of juxtaposed shielded wires covered by a film. A shorting element is secured at an end of the flat cable and engages the shielding layers of the respective shielded wires, and cores of the wires are exposed before the shorting element. U.S. Pat. No. 6,364,702 discloses a connector for such a flat cable. This connector has a housing that holds an end portion of the flat cable. The cores of shielded wires are connected individually with terminal fittings, and the terminal fittings also are held in the housing. The connector also includes a shielding shell that covers the housing and connects with the shielding layers of the shielded wires via the shorting element. The shielding shell achieves shielding effects, such as the removal of radiation noise. This connector is connected with a mating connector secured to a circuit board to connect the flat cable with a circuit on the circuit board.

The housing and the shell of the above-described connector are thin in view of a demand for miniaturization. Thus, center portions of the housing and the shell may deform out and open if the flat cable is pulled in the thickness direction. As a result, the flat cable may detach from the housing or the shielded cables may be cut at positions where the shorting element is secured.

In view of the above, an object of the invention is to provide a connector for a flat cable that can prevent the flat cable from being detached from a housing or being cut when being pulled in the thickness direction.

SUMMARY OF THE INVENTION

The invention relates to a connector for wires with end sections arranged substantially side by side. The wires may be part of a flat cable. The connector includes a housing that holds cores of the wires substantially side by side along a widthwise direction. The connector also includes a shielding shell that is connectable directly or indirectly with shielding layers on at least certain of the wires. The shielding shell covers and shields the housing. The shielding shell has a base shell and a lid shell that can be is opened and closed with respect to the base shell. A locking means is provided between the base shell and the lid shell for keeping the base and lid shells closed. The locking means is at least in a widthwise middle area at a rear end of the housing where the wires drawn out. Accordingly, the base and lid shells are kept closed by the locking means, and the housing and the shielding shell will not deform and open if the wires are pulled in a thickness direction normal to the longitudinal direction of the wires. This prevents the wires from being detached from the housing or being cut.

The shielding shell may comprise at least one wire-pressing portion for preventing the wires from being displaced along the thickness direction. The pressing portion may contact the shielded wires at the rear end of the housing. Accordingly, an external force will not be transmitted to portions of the wires in the housing, and the wires will not be cut, for example, at the shorting element. Wire-pressing portions may be at both the base and lid shells, and the shielded wires are held or sandwiched tightly between the wire-pressing portions.

The wire-pressing portion preferably is formed by bending a rear end of at least one of the base and lid shells to extend back substantially parallel to the flat cable. Thus, large contact surfaces with the shielded wires can be ensured, and it is difficult to damage the shielded wires.

At least one of the base and lid shells may comprise at least one strengthening portion for enhancing bending strength in the thickness direction, which is a direction substantially normal to the longitudinal direction of the wires. The locking means may be provided on the strengthening portion.

The locking means may comprise at least one lock plate inserted between adjacent shielded wires when the base and lid shells are closed.

The invention also relates to a method for mounting or assembling a connector to a plurality of substantially juxtaposed shielded wires. The shielded wires have cores that are held substantially side-by-side in a housing of the connector. The method comprises: providing a shielding shell having a base shell and a lid shell that can be opened and closed with respect to the base shell, mounting the shielding shell on the housing, and keeping the base and lid shells substantially closed with a locking means at a rear end of the housing where the flat cable is drawn out between the base shell and the lid shell.

The locking means for keeping the base and lid shells substantially closed is provided in a substantially widthwise middle portion at the rear end of the housing.

The invention also is directed to a shielding shell for use in the connector described above.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

Figure 1:
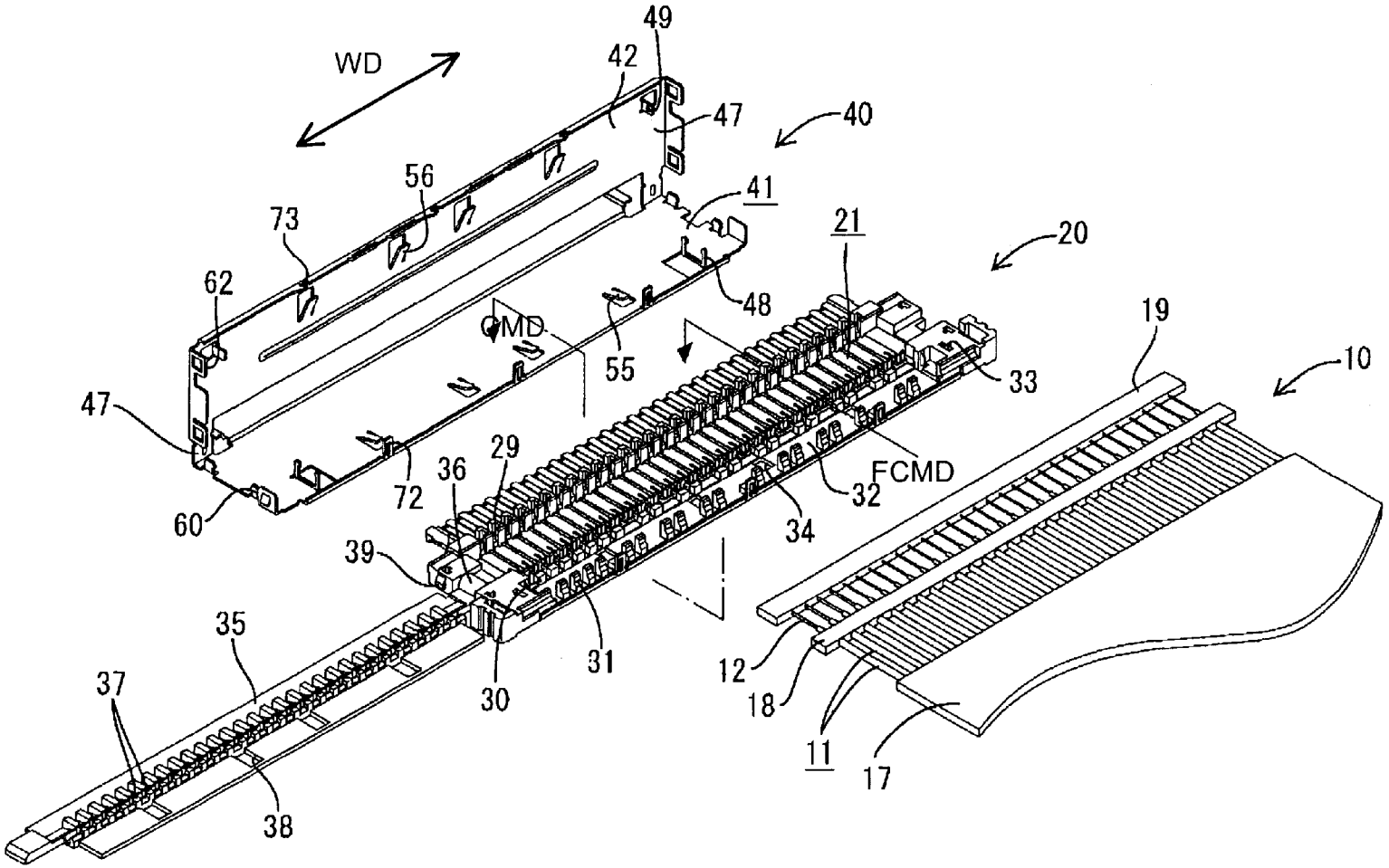
FIG. 1 is an exploded perspective view of a connector according to one embodiment of the invention.

A connector according to the invention includes a housing 20 for receiving an end of a flat cable 10 and a shielding shell 40 mountable on the housing 20, as shown in FIG. 1. This connector is connectable with a mating connector (not shown) that may be secured to a circuit board (not shown) so that the flat cable 10 is connected with a circuit on the circuit board via terminal fittings in the mating connector.

Figure 5:
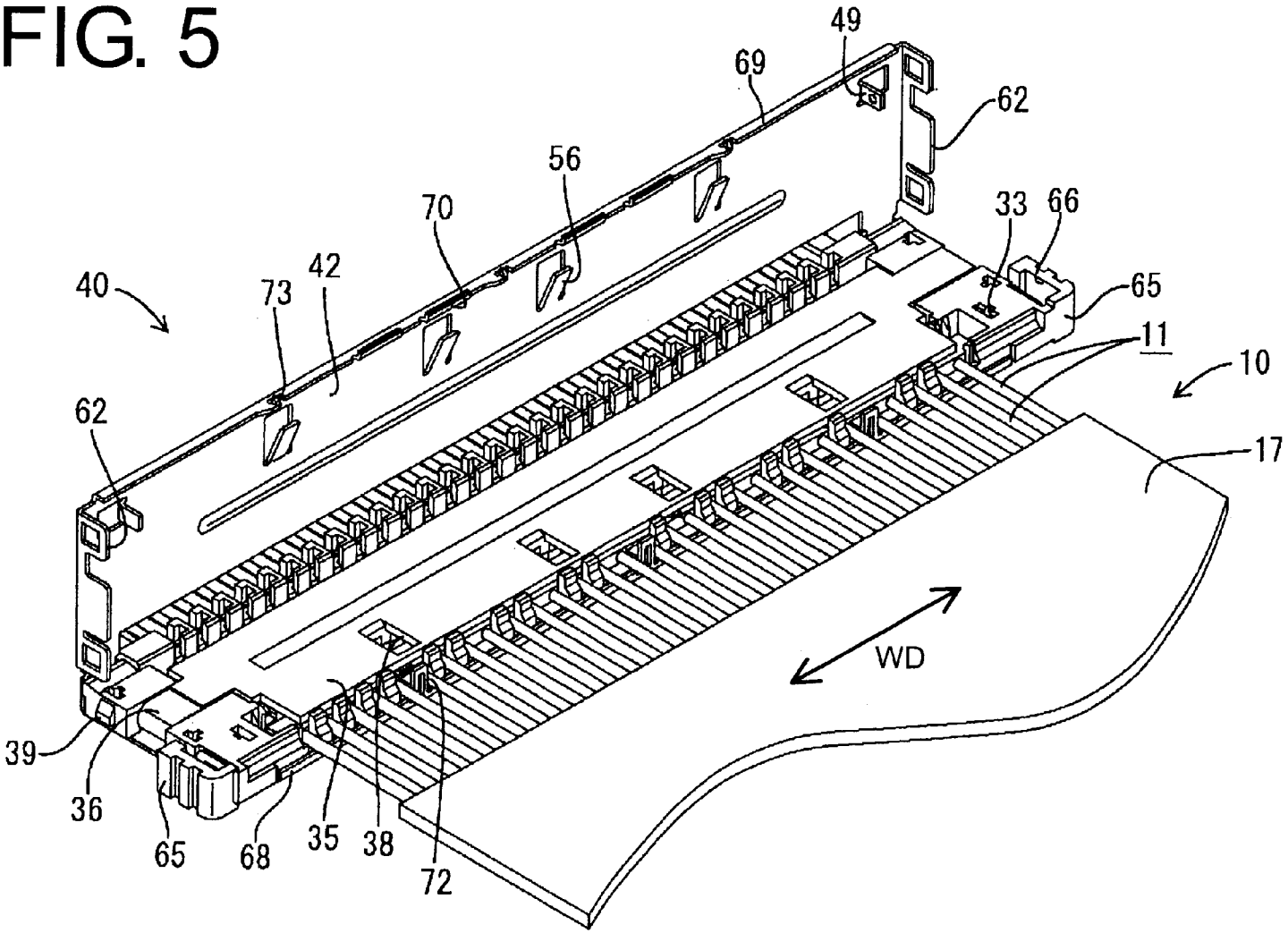
FIG. 5 is a perspective view showing a state where a cover is closed.

A plurality of shielded wires 11 are juxtaposed at specified intervals and are covered by a film 17 to form the strip-like flat cable 10, as shown in FIG. 5. A shorting element 18 is secured near the end of the flat cable 10 and connects to shielding layers 14 of the respective shielded wires 11. This shorting element 18 is constructed such that the shielding layers 14 of the respective shielded wires 11 are sandwiched tightly between two electrically conductive plates that are joined, preferably by soldering. Cores 12 are exposed and project before the shorting element 18, and an alignment sheet 19 keeps the cores 12 juxtaposed at specified intervals.

Figure 2:
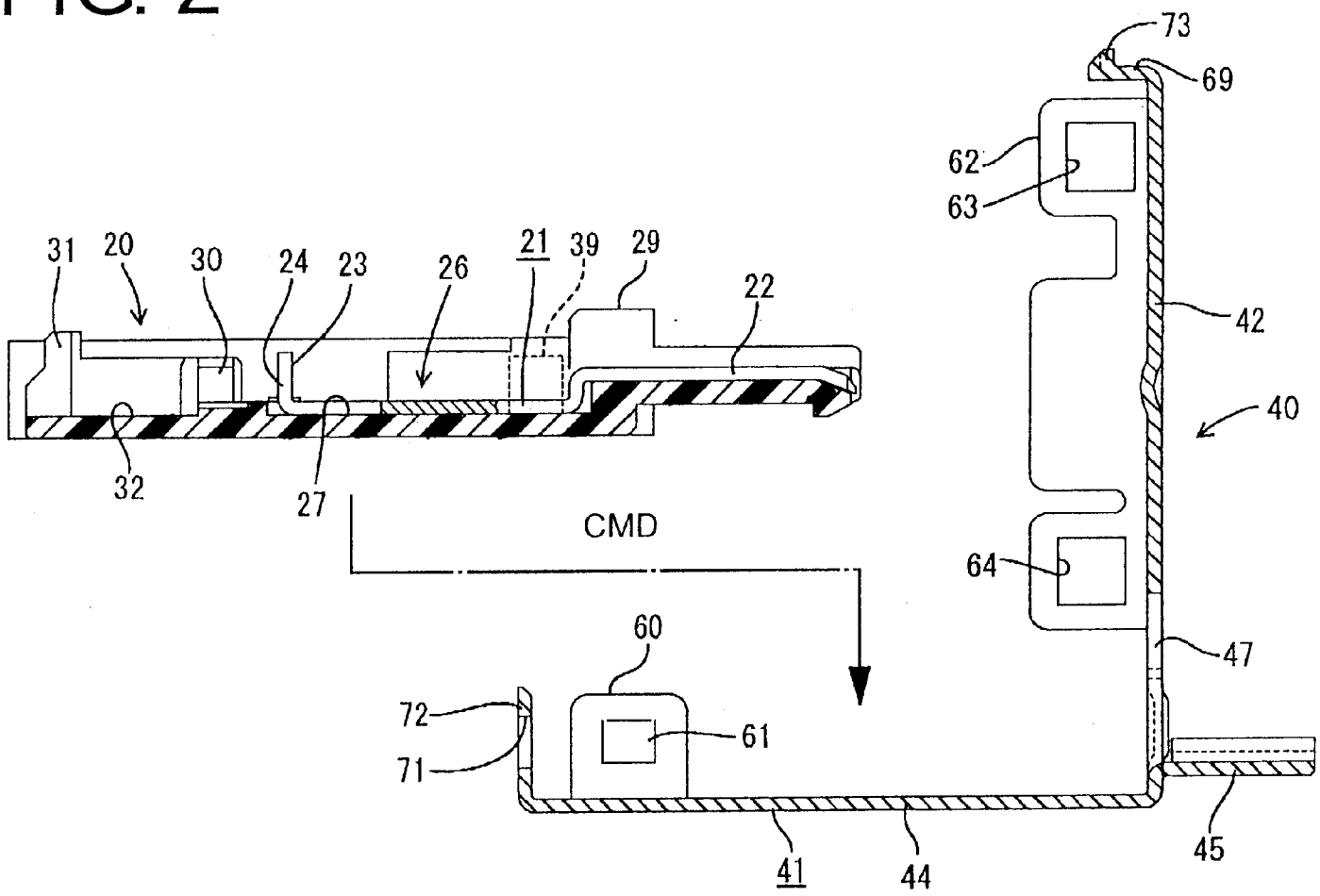
FIG. 2 is a vertical section showing an initial stage of assembling a housing and a shielding shell.

The cores 12 of the respective shielded wires 11 are connected to long narrow insulation-displacement terminal fittings 21 as the shielding wires 11 are mounted in the housing 20. As shown in FIG. 2, a front end of each terminal fitting 21 is bent up to a slightly higher plane, thereby forming a contact 22. A rear end of each terminal fitting 21 is bent up at an angle, and preferably at right angle, and is forked to define an insulation-displacement portion 23. A substantially vertically extending groove of the insulation-displacement portion 23 can be brought into contact with the core 12 of the corresponding shielded wire 11 by insulation displacement.

The housing 20 is made e.g. of a synthetic resin and is wide and thick. A mounting area 26 for the terminal fittings 21 is set at slightly over two thirds of the front side (right side in FIG. 2) of the housing 20. The mounting area 26 is raised slightly at its front end to form a step, and a plurality of terminal insertion grooves 27 are spaced along widthwise direction WD for receiving the terminal fittings 21. Partition walls 29 are formed at the step for partitioning the terminal insertion grooves 27. Accordingly, each terminal fitting 21 can be fit into the corresponding terminal insertion groove 27 while having the contact portion 22 at its leading end placed on the slightly raised portion, as shown in FIG. 2. The terminal fittings in the mating connector contact the contact portions 22 when the housing 20 is connected with the mating connector (not shown).

Guides 30 are formed immediately behind the mounting area 26 of the housing 20 for partitioning inner coatings 13 of the shielded wires 11, and guides 31 are formed at the rear end of the housing 20 for partitioning outer coatings 15 of the shielded wires 11. A placing recess 32 is formed between the guides 30, 31 for receiving the shorting element 18 of the flat cable 10.

A cover 35 substantially covers the upper surface of the housing 20 substantially from the partition wall 29 to the guides 31. The cover 35 is made e.g. of a synthetic resin separately from the housing 20 and is mounted pivotally at one lateral side of the housing 20 via a hinge 36 so as to be assembled as an integral piece.

Pushers 37 are formed on the rear surface of the cover 35 so that each terminal insertion groove 27 has pushers 37 at both front and rear sides of the insulation-displacement portion 23 of each terminal fitting 21 when the cover 35 is closed.

Figure 3:
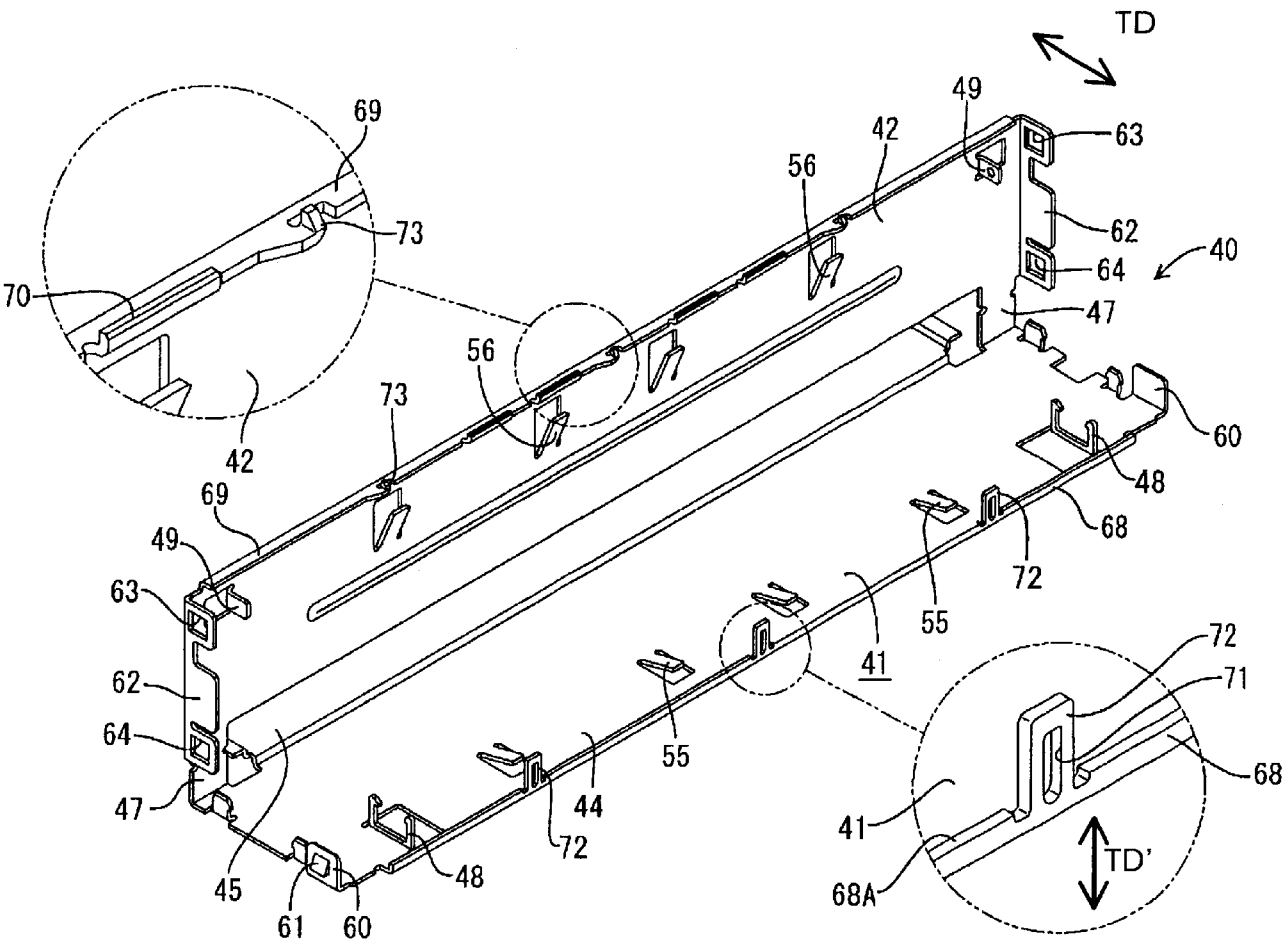
FIG. 3 is a perspective view of the molded shielding shell.

The shielding shell 40 includes a base shell 41 and a lid shell 42 unitarily formed by pressing an electrically conductive metallic plate preferably made of phosphor bronze. Specifically, as shown in FIGS. 2 and 3, the base shell 41 is shaped to be placed on substantially the entire bottom surface of the housing 20, and an elevated portion 45 is formed at the front end of a flat main portion 44, excluding the opposite widthwise ends, for contact with the slightly raised bottom surface of the housing 20 that receives the contact portion 22.

Coupling pieces 47 extend substantially vertically at the opposite lateral ends of the front end of the main portion 44 of the base shell 41, and the lid shell 42 is formed unitarily at the upper ends of the coupling pieces 47. The base shell 41 and the lid shell 42 are formed to align initially at an angle to each other, and preferably substantially a right angle. Further, each coupling piece 47 can be bent at its intermediate position.

Substantially gate-shaped inserting pieces 48 are formed by cutting and bending at positions near the left and right lateral sides of the rear end (front end in FIG. 1) of the base shell 41. Additionally insertion grooves (not shown) vertically penetrate the placing portion 32 at the lateral ends of the placing portion 32 in the housing 20. The base shell 41 and the housing 20 are locked together by closely inserting the inserting pieces 48 of the base shell 41 into the insertion grooves. Similarly, inserting pieces 49 are formed by cutting and bending at positions near the left and right lateral sides of the lid shell 42 and insertion grooves 33 are formed on the upper surface of the housing 20 outside the widthwise ends of the placing portion 32. The lid shell 42 is bent to become substantially parallel with the base shell 41 so that the inserting pieces 49 of the lid shell 42 are inserted closely into these insertion grooves 33 to lock the lid shell 42 and the housing 20 into each other.

Four contact pieces 55 are formed at the rear end of the base shell 41 by cutting and bending. The contact pieces 55 resiliently contact the bottom surface of the shorting element 18 of the above flat cable 10. Windows 34 in the bottom wall of the placing portion 32 receive the contact pieces 55. Likewise, four contact pieces 56 are formed by cutting and bending the pivotal end of the lid shell 42 for resilient contact with the upper surface of the shorting element 18. Windows 38 in the cover 35 receive the contact pieces 56.

A locking plate 60 extends at each of the left and right lateral edges of the base shell 41, and a locking piece 61 is cut and bent to project obliquely down at the outer surface of each locking plate 60. On the other hand, a locking projection 39 is formed at the front of each of the left and right lateral side surfaces of the housing 20. An engaging plate 62 extends at each of the left and right edges of the lid shell 42 and has locking holes 63, 64 that engage the locking piece 61 and the locking projection 39 when the lid shell 42 is substantially parallel with the base shell 41.

As shown in FIG. 5, a finger placing portion 65 bulges out in widthwise direction at the rear end of each of the left and right ends of the housing 20, and a mount hole 66 penetrates vertically through each finger placing portion 65 for receiving the locking plate 60.

Figure 8:
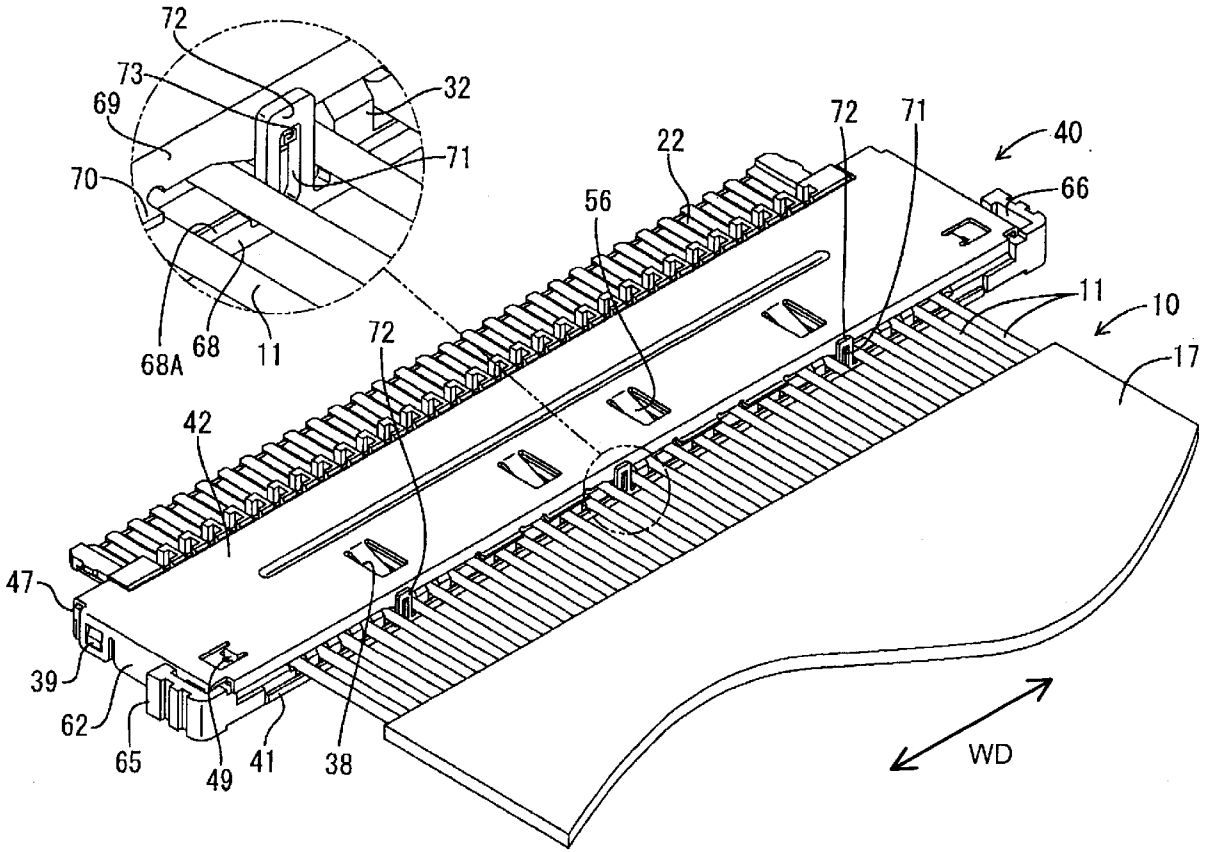
FIG. 8 is a perspective view showing the lid shell completely closed.
Figure 9:
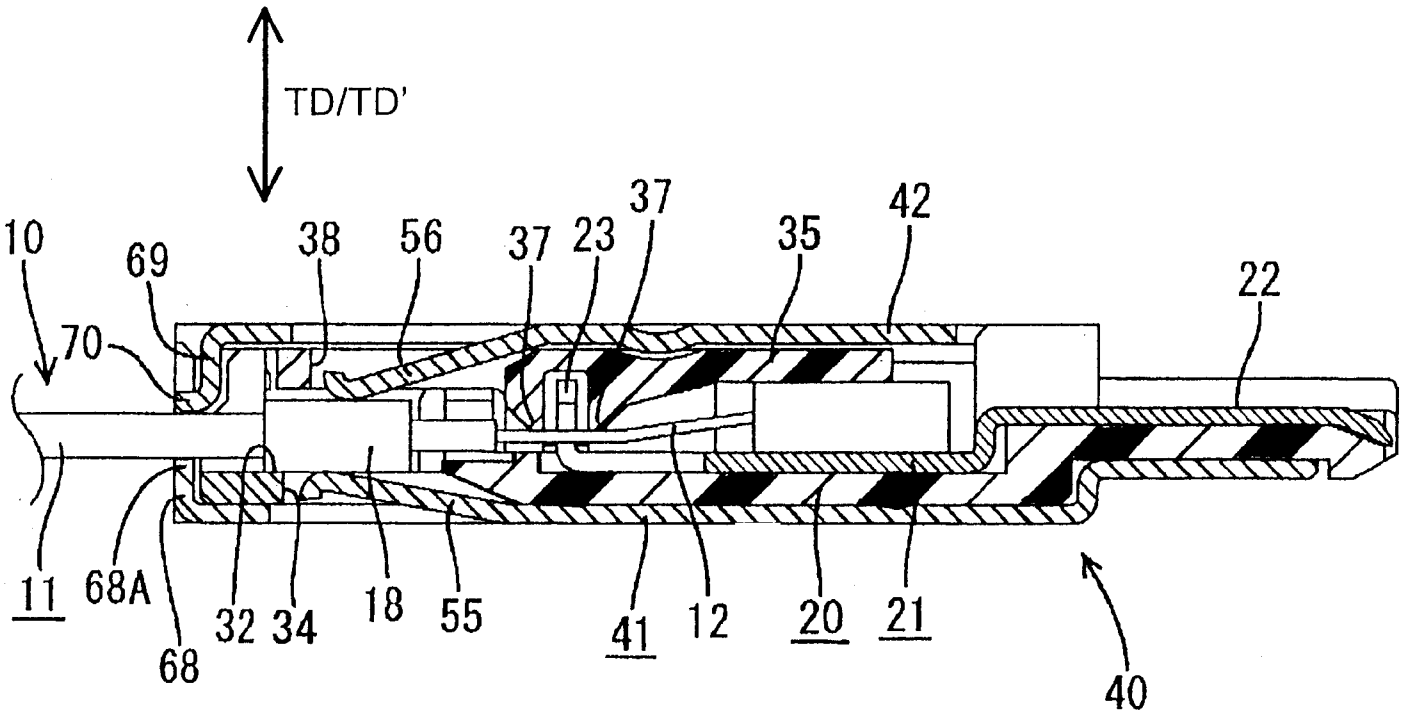
FIG. 9 is a vertical section showing the state of FIG. 8.

A standing edge 68 is formed over substantially the entire width at the rear end of the base shell 41, and a standing edge 69 similarly is formed at the pivotal end of the lid shell 42. The standing edges 68, 69 enhance strength to the base and lid shells 41, 42 with respect to thickness direction TD, TD'. The standing edges 68, 69 are at the rear end of the housing 20 when the base and lid shells 41, 42 are assembled to the housing 20 and the respective shielded wires 11 of the flat cable 10 are drawn out between the standing edges 68, 69, as shown in FIGS. 8 and 9. A wire pressing portion 68A is defined at the leading end of the standing edge 68 of the base shell 41, and contacts the shielded wires 11 after the base shell 41 is assembled with the housing 20. Further, wire pressing portions 70 are formed near the widthwise center and extend toward the pivotal end. The wire pressing portions 70 are held in surface contact with the shielded wires 11 after the lid shell 42 is assembled with the housing 20. The wire pressing portions 68A, 70 are substantially opposed to each other. Thus, the shielded wires 11 are held tightly between the wire pressing portions 68A, 70 when the housing 20 and the shielding shell 40 are assembled with each other.

Three spaced apart lock plates 72 extend at the standing edge 68 of the base shell 41 and each is formed with a locking groove 71. Hooks 73 are formed at the standing edge 69 of the lid shell 42 and substantially conform to the lock plates 72. The hooks 73 are engageable with the locking grooves 71 when the lid shell 42 is bent to be substantially parallel with the base shell 41.

The terminal fittings 21 are mounted into the corresponding terminal insertion grooves 27 of the housing 20 with the cover 35 opened. Subsequently, the housing 20 is moved in the cover mounting direction CMD onto the base shell 41 of the shielding shell 40 as indicated by an arrow in FIG. 2. The inserting pieces 48 then are inserted into the corresponding insertion holes (see FIG. 4).

Figure 4:
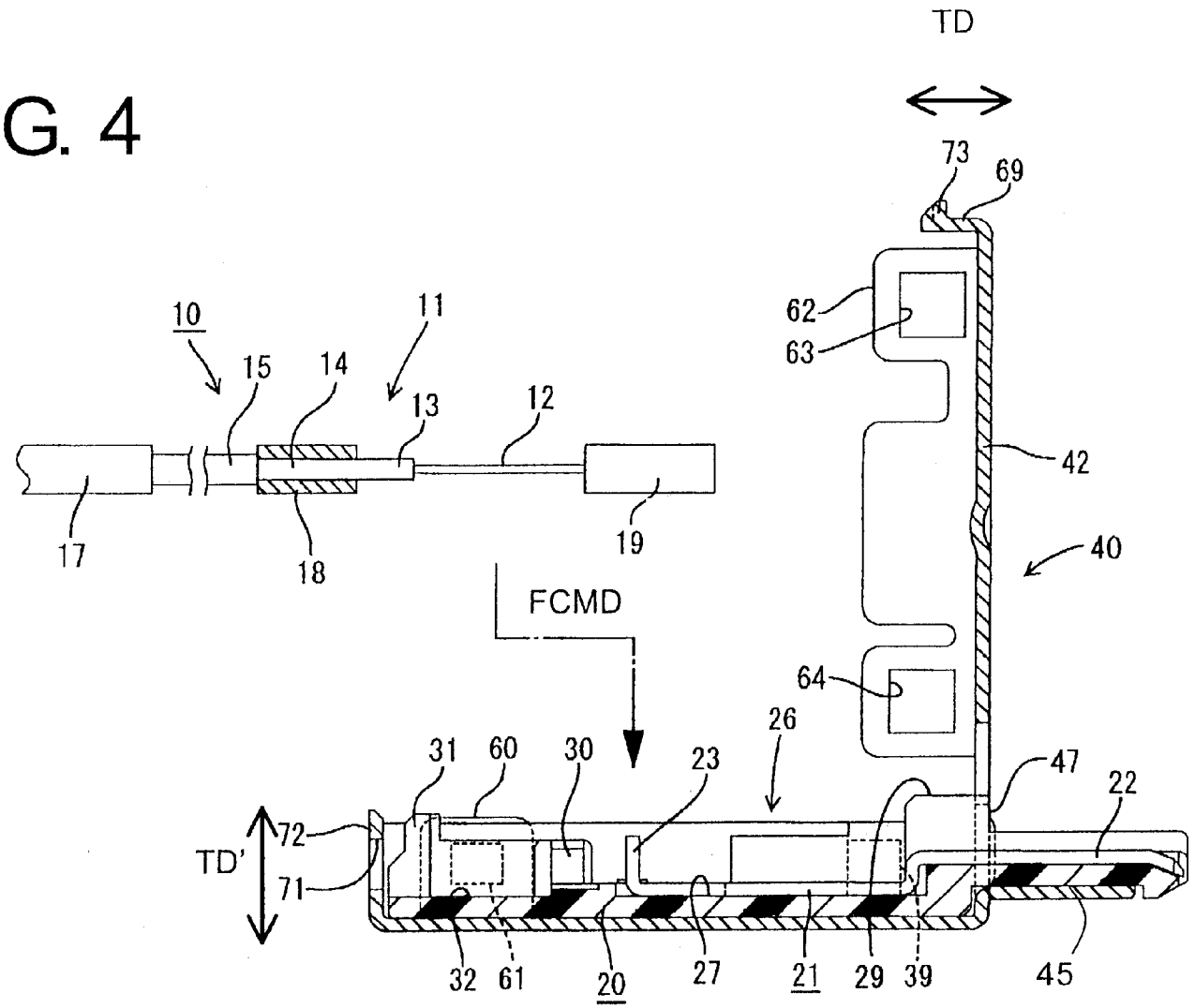
FIG. 4 is a vertical section showing an operation of mounting an end of a flat cable.

The end of the flat cable 10 then is mounted into the mounting area 26 of the housing 20 from above as indicated by an arrow for the flat cable mounting direction FCMD in FIG. 4. Thus, the shorting element 18 is positioned on the placing portion 32. Simultaneously, the cores 12 of the shielded wires 11 are pressed into the insulation-displacement grooves 24 of the insulation-displacement portions 23 of the corresponding terminal fittings 21 (see FIG. 6) to connect the shielded wires 11 to the terminal fittings 21.

Figure 6:
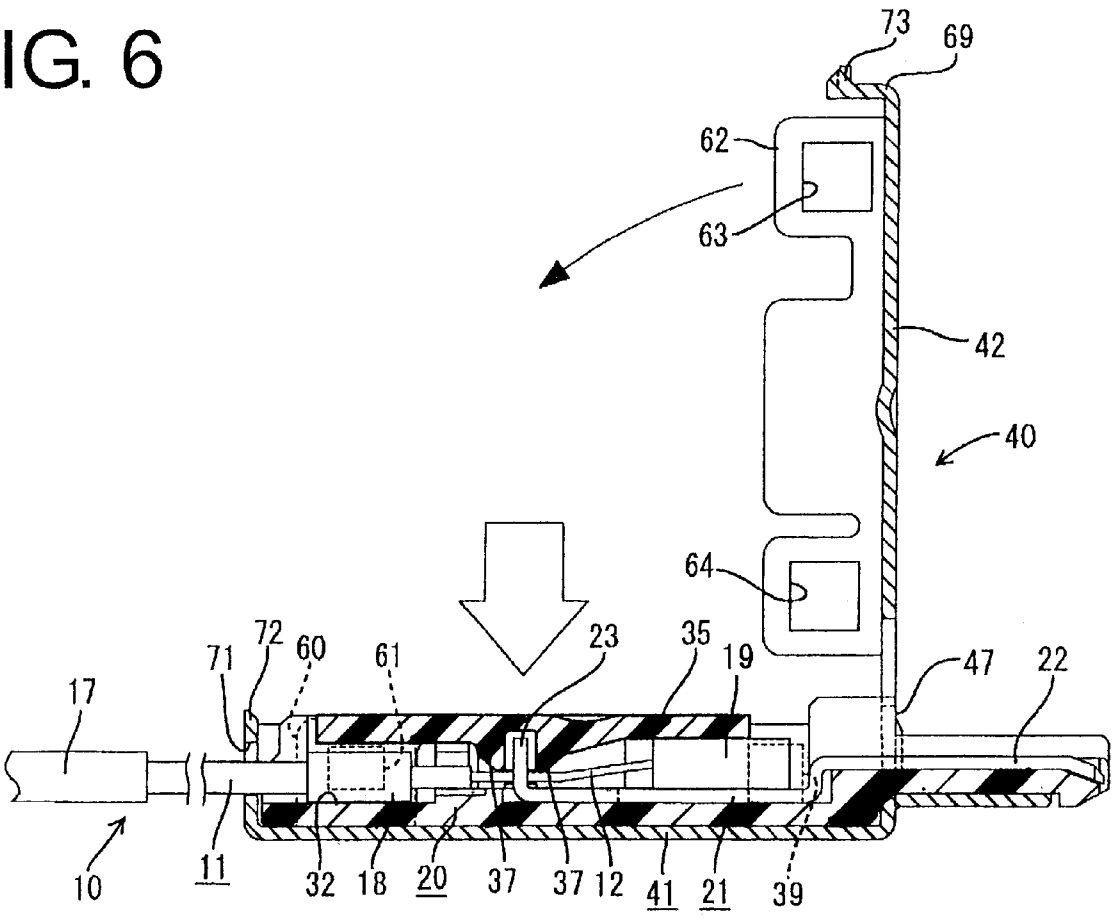
FIG. 6 is a vertical section showing an operation of closing a lid shell.

The cover 35 then is pivoted about the hinge 36 and into a closed position where the cover 35 is substantially parallel to the housing 20, as shown in FIG. 5. Simultaneously, as shown in FIG. 6, each pair of front and rear pressing portions 37 on the rear surface of the cover 35 press the core of the corresponding shielded wire 11 at the front and rear sides of the corresponding insulation-displacement portion 23 to keep the shielded wire 11 connected by insulation displacement.

Figure 7:
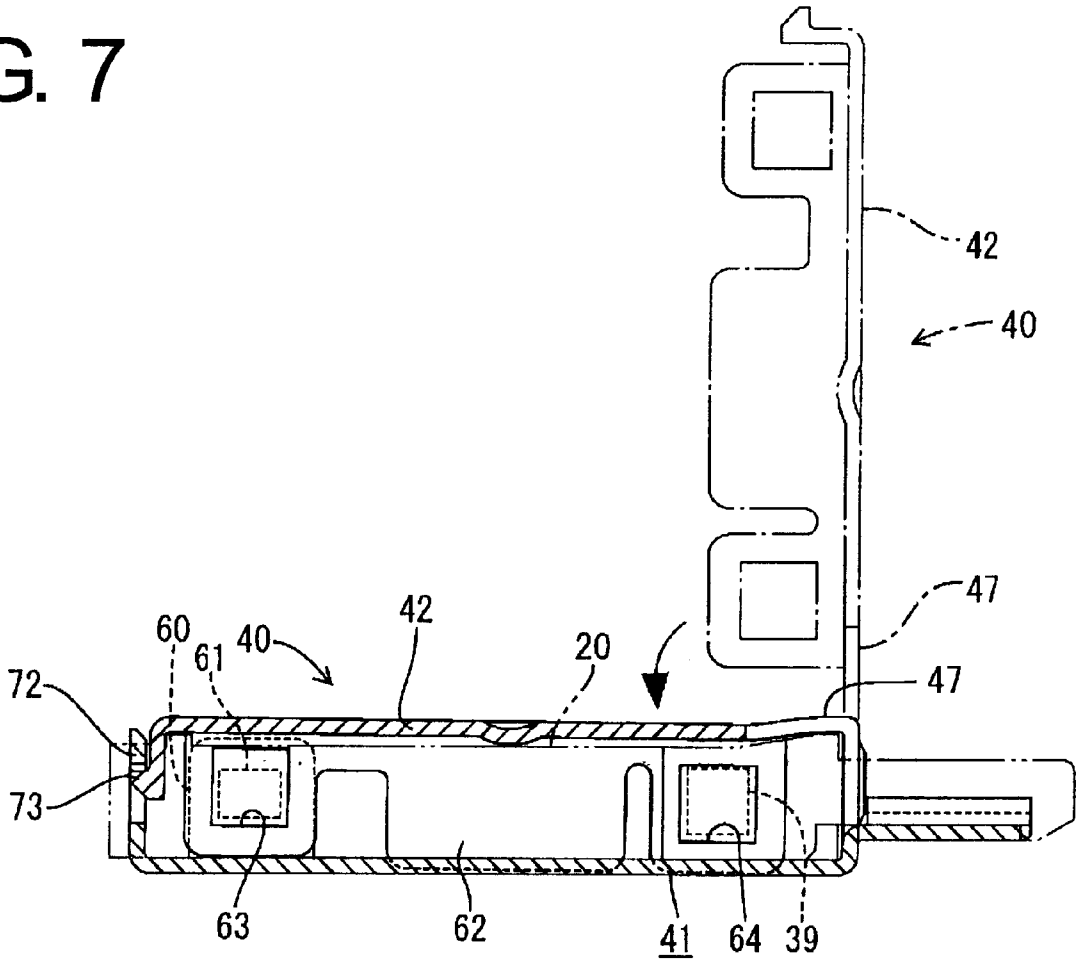
FIG. 7 is a diagram showing how the lid shell is closed.

Subsequently, the lid shell 42 is bent back at specified positions of both coupling pieces 47, as indicated by an arrow in FIG. 7. A 90° rotation of the lid shell 42 causes the inserting pieces 49 to be inserted closely into the insertion grooves 33 of the housing 20. Further, as shown in FIGS. 7 to 9, the hooks 73 at the pivotal end of the lid shell 42 fit resiliently into the locking grooves 71 of the corresponding lock plates 72 of the base shell 41 at the rear end of the housing 20. Additionally, the locking pieces 61 of the locking plates 60 and the locking projections 39 of the housing 20 fit resiliently into the locking holes 63, 64 of the corresponding engaging plates 62 at the lateral ends of the housing 20. Thus, the base and lid shells 41, 42 are closed and locked into each other and tightly hold the housing 20 therebetween.

In this way, the lid shell 42 presses the cover 35, and the cores 12 of the wires 11 are kept connected by insulation displacement. Simultaneously, the contact pieces 55, 56 of the base and lid shells 41, 42 are pressed resiliently against the outer surfaces of the shorting element 18 through the windows 34, 38 of the housing 20 and the cover 35 to establish electrical contacts. As a result, the shielding shell 40 substantially surrounds the housing 20 and provides shielding effects, such as removal of radiation noise.

The wire pressing portion 68A of the base shell 41 is held in contact with the shielded wires 11 at the rear end of the housing 20 where the flat cable 10 is drawn out. Additionally, the wire pressing portions 70 of the lid shell 42 are held in surface contact with the shielded wires 11. As a result, the shielded wires 11 are held tightly between by the wire pressing portions 68A, 70.

As described above, the base and lid shells 41, 42 are kept closed by the lock plates 72 and hooks 73 substantially in the widthwise middle at the rear end of the housing 20 where the flat cable 10 is to be drawn out of the connector. Thus, the housing 20 and the shielding shell 40 are not resiliently deformed to open when the flat cable 10 is pulled in thickness direction TD, TD' substantially normal to the plane of the flat cable 10. Therefore, the flat cable 10 will not be cut or detached from the housing 20.

The wire pressing portions 68A, 70 at the rear end of the housing 20 prevent displacement of the shielded wires 11 in response to pulling forces on the flat cable 10 in the thickness direction TD, TD'. Thus, an external force is unlikely to be transmitted to a portion of the flat cable 10 held in the housing 10 and the flat cable 10 will not be cut, for example, where the shorting element 18 is secured.

The wire pressing portions 70 are formed by bending the end portions of the lid shell 42 to extend back and out away from the elevated portion 45 in a direction substantially parallel to the shielded wires 11. Thus, a large contact surface is achieved, and it is difficult to damage the shielded wires 11.

The invention is not limited to the above described and illustrated embodiment. For example, the following embodiments also are embraced by the technical scope of the invention as defined by the claims. Beside the following embodiments, various changes can be made without departing from the scope and spirit of the present invention as defined by the claims.

Figure 10:
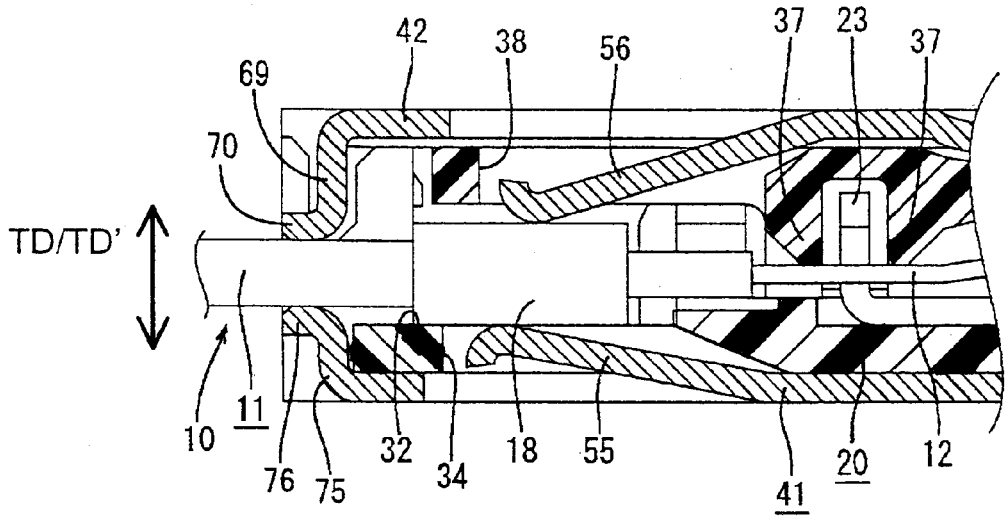
FIG. 10 is a partial enlarged section showing a rear end portion of a connector according another embodiment.

As shown in FIG. 10, an end the standing edge 75 of the base shell 41 is bent back to form wire pressing portions 76 that face the wire pressing portions 70, and the wire pressing portions 70, 76 are held tightly in surface contact with the shielded wires 11 from upper and lower sides. With such a construction, the shielded wires 11 less likely to be damaged when the flat cable 10 is pulled.

The shielding shell may be formed by assembling a base shell and a lid shell formed as separate parts.

The exposed cores of the flat cable may be held in the housing instead of providing the terminal fittings, and the terminal fittings of the mating connector may be connected directly with the cores.

The wire pressing portions may be provided at both base and lid shells or may be provided at either one of them.

What is claimed is:

1. A connector for a plurality of wires, at least one of said wires being a shielded wire having a shielding layer, at least portions of said wires being substantially juxtaposed such that conductive cores of the respective wires are held substantially side by side in a housing, the housing having a rear end and portions of the wires being drawn out of the connector at the rear end of the housing, the connector comprising:

a shielding shell including a base shell covering a first portion of the housing and a lid shell moveably disposed with respect to the base shell for covering a second portion of the housing; and locks extending between the base shell and the lid shell at the rear end of the housing where the wires are drawn out for keeping the base and lid shells substantially closed around the housing the locks comprising at least one lock provided in a substantially widthwise middle at the rear end of the housing.

2. The connector of claim 1, wherein the shielding shell comprises at least one wire pressing portion for being held in contact with the wires at the rear end of the housing and preventing the wires from being displaced.

3. The connector of claim 1, comprising at least two of the wire pressing portions provided respectively at the base and lid shells, and the wires being held tightly between the wire pressing portions.

4. The connector of claim 3, wherein the wire pressing portions are formed unitarily with the shielding shell by bending a rear end of at least one of the base and lid shells to extend backward.

5. The connector of claim 1, wherein at least one of the base and lid shells comprises at least one strengthening portion for enhancing bending strength with respect to a thickness direction.

6. The connector of claim 5, wherein the at least one of the locks is provided at least partly on the strengthening portion.

7. A connector for a plurality of wires, at least one of said wires being a shielded wire having a shielding layer, at least portions of said wires being substantially juxtaposed such that conductive cores of the respective wires are held substantially side by side in a housing, the housing having a rear end and portions of the wires being drawn out of the connector at the rear end of the housing, the connector comprising:

a shielding shell including a base shell covering a first portion of the housing and a lid shell moveably disposed with respect to the base shell for covering a second portion of the housing; and locks extending between the base shell and the lid shell at the rear end of the housing where the wires are drawn out for keeping the base and lid shells substantially closed around the housing the locks comprising at least one lock provided in a substantially widthwise middle at the rear end of the housing, the locks comprises at least one lock plate inserted between adjacent wires upon closing the base and lid shells.

8. A connector for a plurality of wires, each of said wires having a conductive core and at least one of said wires being a shielded wire having a shielding layer, comprising:

a housing having opposed front and rear ends, portions of said housing between said front and rear ends being configured for holding portions of the wires substantially side by side and for holding portions of the wires in a plane extending between opposite side of the housing, said rear end of the housing being configured for permitting the wires to be drawn out of the connector; and a shielding shell unitarily formed from a conductive material and having a base shell disposed substantially adjacent a first part of the housing and a lid shell moveable with respect to the base shell between an open position where the housing can be positioned on the base shell and a closed position where the base and lid shells substantially enclose the housing, the shielding shell further comprising locks at the rear end of the housing, for keeping the base and lid shells substantially closed, the locks comprising at least one lock plate intermediate the opposite sides of the housing and disposed for insertion between adjacent wires upon moving the lid shell into the closed position of the base shell.

9. The connector of claim 8, wherein the shielding shell comprises at least one wire pressing portion configured for contacting the wires at the rear end of the housing and preventing the wires from being displaced.

10. The connector of claim 9, comprising at least two of the wire pressing portions provided respectively at the base and lid shells and the wires being held tightly between the wire pressing portions.

11. The connector of claim 10, wherein the wire pressing portions are formed unitarily with the shielding shell by bending a rear end of at least one of the base and lid shells to extend backward.

12. The connector of claim 11, wherein the base and lid shells each has a main portion aligned substantially parallel to the portions of the wires held in the housing, and at least one strengthening wall aligned substantially normal to the main portions at the rear end of the housing for enhancing bending strength with respect to a thickness direction.

13. The connector of claim 12, wherein the locking means extends unitarily from the strengthening wall.

14. A method of mounting a connector on a plurality of juxtaposed shielded wires, in which connector cores of the respective shielded wires are held substantially side by side along in a housing and a shielding shell connectable with shielding layers of the respective shielded wires to substantially cover the housing, comprising the following steps:

providing the shielding shell having a lid shell openably and closably provided with respect to a base shell mounting the shielding shell on the housing, and keeping the base and lid shells substantially closed by means of locks at a rear end position of the housing where the shielded wires are drawn out between the base shell and the lid shell including at least one lock in a substantially widthwise middle portion at the rear end position of the housing.

* * * * *